United States Patent [19]

Kennedy et al.

[11] Patent Number: 4,481,100

[45] Date of Patent: Nov. 6, 1984

[54] SURGE BIN RETORTING SOLID FEED MATERIAL

[75] Inventors: Clinton R. Kennedy, Talleyville, Del.; Frederick J. Krambeck, Cherry Hill, N.J.

[73] Assignee: Mobil Oil Corporation, New York, N.Y.

[21] Appl. No.: 518,576

[22] Filed: Jul. 29, 1983

[51] Int. Cl.[3] ..... C10G 1/02

[52] U.S. Cl. ..... 208/11 R; 208/8 R; 201/23

[58] Field of Search ..... 208/8 R, 11 R; 201/23

[56] References Cited

U.S. PATENT DOCUMENTS

| | | | |
|---|---|---|---|
| 2,717,869 | 9/1955 | Turner | 201/23 |
| 2,939,893 | 6/1960 | Parker et al. | 201/38 |
| 4,161,441 | 7/1979 | Morrell | 208/11 R |
| 4,377,465 | 3/1983 | York | 208/8 R |

*Primary Examiner*—Delbert E. Gantz
*Assistant Examiner*—Anthony McFarlane
*Attorney, Agent, or Firm*—Alexander J. McKillop; Michael G. Gilman; Charles J. Speciale

[57] ABSTRACT

An improved surge bin for a Lurgi-Ruhrgas process has baffles which promote uniform flow of feed material through the surge bin. Improved retorting of kerogen from oil shale is obtained. Stripping gas such as steam, is supplied to the surge bin. A separator has a large disengaging volume to remove entrained solid particles and improve the quality of the hydrocarbon product.

2 Claims, 2 Drawing Figures

SURGE BIN RETORTING SOLID FEED MATERIAL

BACKGROUND OF THE INVENTION

This invention relates to retorting of hydrocarbons from solid feed material, and more particularly, to an improved surge bin for a flash pyrolysis process.

Flash pyrolysis has been applied to coal, oil shale, tar sands, and other solid feed materials to produce synthetic fuels. "PRODUCTION OF SYNFUELS FROM OIL SHALE, TAR SANDS AND COAL BY THE LR-PROCESS" by Dr. Hans J. Weiss, paper presented at the Synfuels First Worldwide Symposium, Oct. 7-9, 1981, (LR) Brussels, describes the Lurgi-Ruhrgas (LR) process. This process has been operated to carbonize coal, to crack crude oil, fuel oils, and naphtha into olefins and to produce synthetic fuel from oil shale, tar sands, and diatomaceous earth. In this process, the feed material is flash heated by circulating a solid heat carrier material through a mixer. The heat carrier is the feed residue which is produced in the process.

As an example, when oil shale is the feed in the LR process, a screw mixer mixes preheated raw shale, and hot spent shale. Retorting begins in the mixer. The solid material is transferred from a mixer to the surge bin where retorting continues. The surge bin provides a buffer for flow of solid material to a lift pipe in which the circulating solid heat carrier material is reheated and conveyed back to the mixer.

Prior art surge bins used in the Lurgi process do not promote uniform flow of solid material through the surge bin. Because of this, unretorted hydrocarbons can be carried to the spent shale combustion section and burned. The solid material in the surge bin may be self-fluidized from the evolution of hydrocarbons and there is considerable mixing in the bin. Because of this, some of the larger pieces of solid material may sink through the fluidized bed faster than the smaller particles. This results in significant solids bypassing, thereby reducing the yield of usable hydrocarbons.

It is an object of the present invention to promote uniform flow through the surge bin in an LR process.

It is another object of the present invention to improve the quality of the hydrocarbon product by reducing the amount of fine entrained solids in the oil.

It is another object of the present invention to provide gas or steam stripping in the surge bin to remove entrained hydrocarbons from the solid material and reduce residence time of the product vapors.

SUMMARY OF THE INVENTION

In accordance with the present invention, the surge bin in an LR process promotes uniform flow of solid material therethrough to achieve more complete retorting of hydrocarbons from the solid material in the surge bin. In accordance with the invention, baffles are provided in the surge bin to promote uniform flow. Further in accordance with the present invention, stripping gas or stripping steam is supplied to the surge bin to remove entrained hydrocarbons and reduce residence time of product vapors.

Further in accordance with the invention, an enlarged disengaging volume is provided on the output of the mixer and surge bin to provide better separation of solid material from gas.

The foregoing and other objects, features and advantages of the invention will be better understood from the following more detailed description and appended claims.

SHORT DESCRIPTION OF THE DRAWINGS

DESCRIPTION OF THE PREFERRED EMBODIMENT

Figure 1:
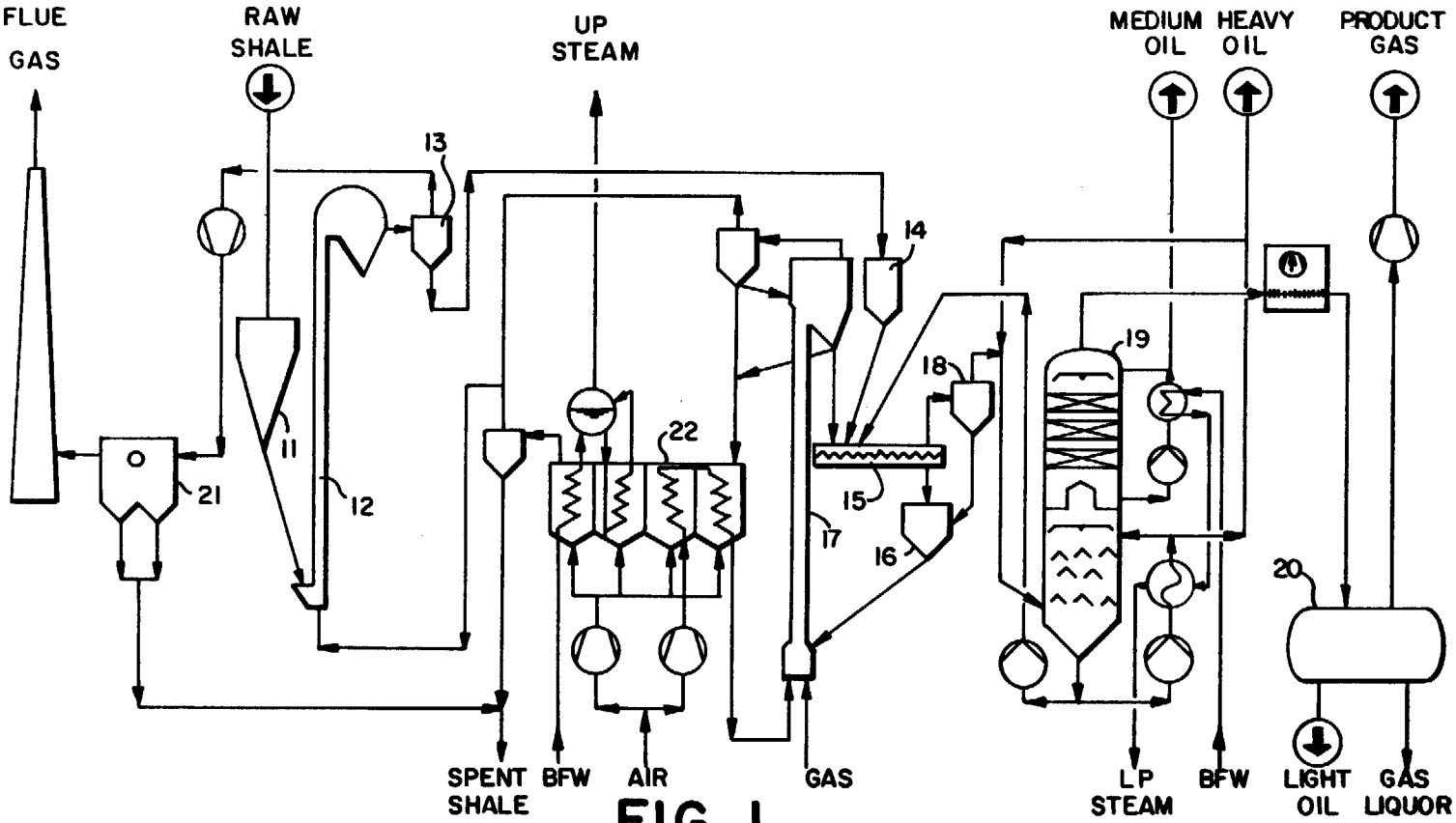
FIG. 1 (PRIOR ART)
FIG. 1 depicts a prior art LR processing system.

Referring to FIG. 1, raw feed material such as shale is supplied to the preheating section which includes hopper 11 and riser 12 which has hot air or flue gas supplied to the bottom thereof. The raw shale is transferred to the separator 13 and from there it is supplied to the "loop" which is where the principal retorting takes place in an LR process.

Preheated raw shale from hopper 14 is supplied to the screw mixer 15 which mixes the raw feed material with hot circulating solid heat carrier material to induce retorting. Fresh shale at approximately 300° F. is mixed with hot spent shale at 1250° F. in the mixer 15. Retorting begins in the mixer 15 and continues in the surge bin 16 wherein the mixture resides at about 980° F. for a residence time of about 5 minutes. This retorting produces solid heat carrier material which is supplied to lift pipe 17. Hot gas is supplied to the bottom of lift pipe 17 and the remaining hydrocarbons in the solid material are burned to reheat the carrier material before it is conveyed back to the mixer 15 in a circulating path.

Gas produced as a result of retorting is supplied to cyclone separator 18 where it is further disengaged from solid material. The gas is supplied to the condensation section which includes a catcracker fractionator-type condensing tower 19 and a final air cooler condenser 20. In the lower stage of condensing tower 19 a heavy oil fraction is condensed at 200°-300° C. and residual dust is removed. In the upper stage of condensing tower 19 the product vapors are cooled to approximately 100°-150° C. and a water and dust-free medium oil is condensed. In the final air cooler condenser 20, light oil, naphtha, and gas liquor are condensed leaving a high BTU retort gas at approximately 50° C.

Flue gas is de-dusted in an electrostatic precipitator 21 before being discharged to the atmosphere. In order to cool the spent shale, it is supplied to the four-stage heat exchanger 22 where the shale contacts air and gas which is heated for use in the process.

In a process of the type just described, it is desirable to retort as much of the hydrocarbons as possible into usable product. We estimate that prior art LR processes retort a maximum of 18% of the kerogen from oil shale in the screw mixer with a 5 second residence time. The remainder of the kerogen in the shale must be retorted in the surge bin. However, in the prior art processes no attempt is made to promote uniform flow through the surge bins or to strip hydrocarbons off the spent shale in the surge bin. This can lead to bypassing of incompletely retorted shale and considerable loss in yield. Any unretorted hydrocarbons are carried to the lift pipe 17 where they are burned.

Figure 2:
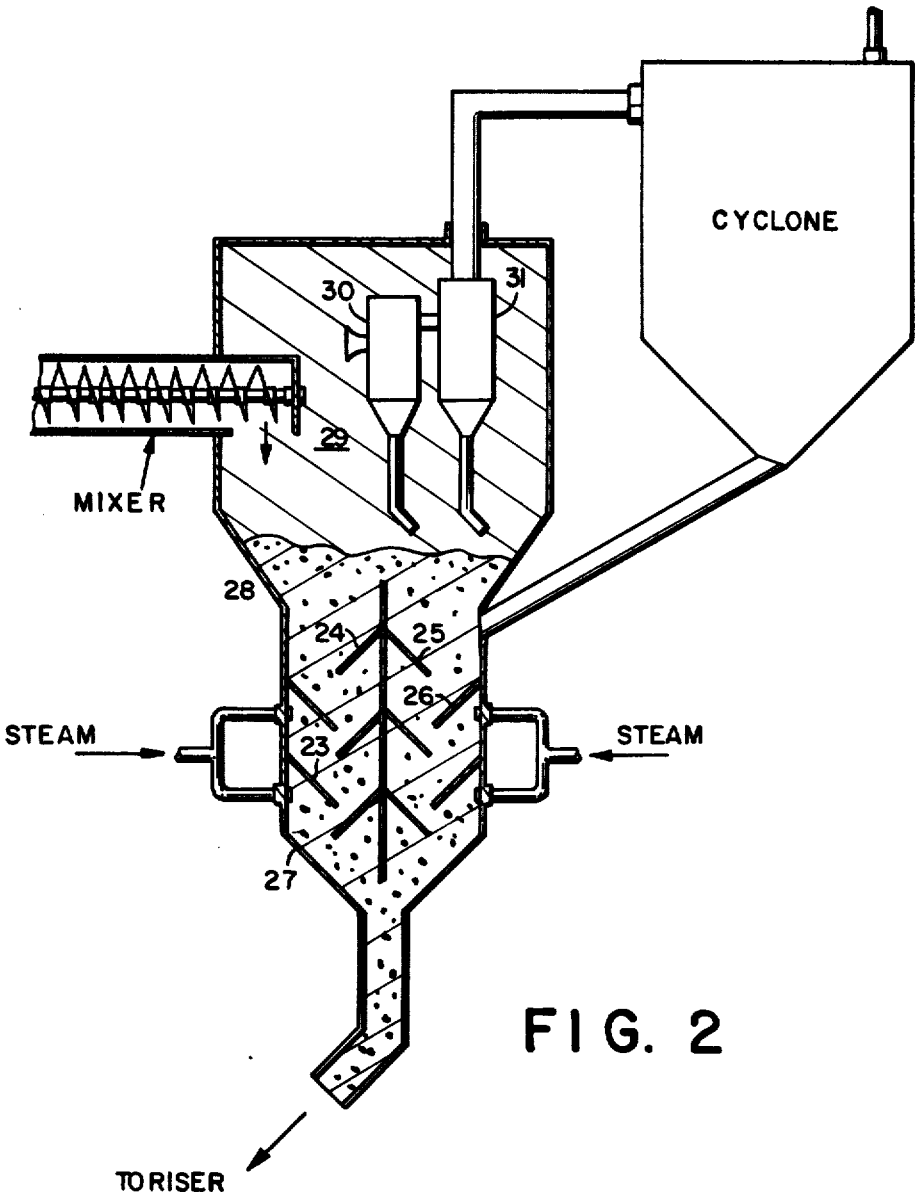
FIG. 2 depicts the improved surge bin separator of the present invention.

In accordance with the present invention, uniform flow through the surge bin is promoted by providing the baffles such as those indicated at 23-26 in FIG. 2. The specific baffle configuration will be dependent upon the nature of solids flow.

Uniform flow is also promoted by providing a lower section between 27 and 28 which has a smaller uniform crosssection than the upper disengaging section 29. Because of this difference between crosssections, the upper section of the surge bin holds a variable quantity of solid material which flows uniformly through the lower section 28 where more complete retorting takes place.

A major problem in the LR retort is fines carry-over. Much of this can be avoided if the spent shale disengaging section 29 has increased volume. Gas velocity through the system can be significant and a large disengaging volume is required to reduce velocity and separate the solids from the gas. Further in accordance with the present invention, fines are disengaged from the gas by a series of secondary cyclone separators 29, 30, 31, and others. Evolving gases are supplied to these separators for disengaging the fines.

If the disengaging volume is increased, and retorting temperature (−980° F.) may have to be reduced to maintain low thermal cracking. The cyclones can be positioned inside or outside the disengaging section 29 depending on the volume available. The solids are returned to the surge bin by flapper valves or dip legs, for example.

Further in accordance with the invention, stripping gas or steam is supplied to remove entrained oil. The steam also increases the linear velocity through the bin thus reducing the residence time for thermal cracking. By reducing hydrocarbon partial pressure, condensation and coking are less likely.

The advantage of uniform flow through the surge bin can be seen from the following analysis which compares the conversion percentage of kerogen on shale for three different types of flow, namely plug flow which is the ultimate in uniform flow, and can be approached with baffling, well mixed flow (complete mixing), and flow wherein there is bypassing of solids which is the type of flow achieved in prior art LR surge bins.

| | Lurgi Retort Analysis | |
|---|---|---|
| | Residence Time (sec.) | Conversion (%) |
| Mixer | 5 | 18 |
| Surge Bin | 300 | |
| Plug Flow | | 100 |
| Well-Mixed | | 94 |

-continued

| | Lurgi Retort Analysis | |
|---|---|---|
| | Residence Time (sec.) | Conversion (%) |
| Solids Bypassing | | 80 |

If the surge bin is operated in plug flow, the 5 minute residence time would be more than adequate to achieve complete retorting of the shale. This flow pattern is unlikely in the present design, however. The surge bin is probably self-fluidized from the evolution of 82% of the unretorted kerogen and there may be considerable mixing in the bin. If the flow pattern in the bin approaches perfect mixing, the conversion of the shale in five minutes is about 94% complete. If the bin is fluidized, there will probably be some bypassing of the larger pieces of shale since they will sink through the fluidized bed faster than the smaller particles. With significant solids bypassing, the conversion could be as low as 80%. Bypassing can be essentially eliminated by proper baffling of the surge bin as shown in FIG. 2.

While a particular embodiment of the invention has been shown and described, various modifications are within the true spirit and scope of the invention. The appended claims are, therefore, intended to cover all such modifications.

What is claimed is:

1. The method of retorting hydrocarbons from solid feed material comprising:

mixing hot circulating solid heat carrier material produced in said method with raw feed material to induce retorting:

reheating said circulating solid heat carrier material and conveying it to said mixer;

supplying a mixture of said solid heat carrier and partially retorted feed material from said mixer to a surge bin;

baffling the flow of said mixture through said surge bin to promote uniform flow and to improve further retorting of said material in said surge bin;

supplying gas retorted from the material in said surge bin to a series of separators positioned in the upper section of said surge bin, each having a disengaging volume to disengage said gas from solid material carried by said gas; and supplying steam to said surge bin at a temperature which promotes stripping to remove entrained hydrocarbons from said solid material.

2. The method recited in claim 1 wherein said raw feed material is oil shale.

* * * * *